US006145418A

United States Patent [19]

Bares

[11] Patent Number: 6,145,418

[45] Date of Patent: Nov. 14, 2000

[54] LAMINATED HAND TOOL ASSEMBLY

[75] Inventor: James D. Bares, Gates Mills, Ohio

[73] Assignee: Meritool Corp., Chagrin Falls, Ohio

[21] Appl. No.: 09/332,749

[22] Filed: Jun. 14, 1999

[51] Int. Cl.[7] ..... B25B 7/02

[52] U.S. Cl. ..... 81/421; 81/427.5

[58] Field of Search ..... 81/300, 418, 420, 81/421, 423, 424, 427.5, 489

[56] References Cited

U.S. PATENT DOCUMENTS

| | | | |
|---|---|---|---|
| 4,894,913 | 1/1990 | Ladin . | |
| 5,031,483 | 7/1991 | Weaver . | |
| 5,113,727 | 5/1992 | Foster | 81/423 |
| 5,351,584 | 10/1994 | Warheit . | |
| 5,503,049 | 4/1996 | Chervenak et al. | 81/427.5 |
| 6,014,917 | 1/2000 | Bally et al. | 81/355 |

*Primary Examiner*—Timothy V. Eley
*Assistant Examiner*—Dung Van Nguyen
*Attorney, Agent, or Firm*—Vickers, Daniels & Young

[57] ABSTRACT

An improved hand tool assembly includes first and second rigid members, each having a handle portion, a throat portion and a working end, the members being joined by a pivot pin in a scissors-like arrangement whereby the working ends are caused to move toward each other in response to the handle portions being moved toward each other. Each of the first and second rigid members is of a laminated construction which includes a plurality of substantially flat laminations, preferably manufactured from stamped parts. First and second molded metal jaw members are adhesively affixed to the working ends of the first and second rigid members.

18 Claims, 8 Drawing Sheets

LAMINATED HAND TOOL ASSEMBLY

The present invention is directed to a laminated hand tool assembly which is uniquely fitted with jaws affixed to the working end. The tool can be easily manufactured as a crimper, cutter, or other plier-like hand tool.

BACKGROUND OF THE INVENTION

For many years, hand tools such as crimpers, cutters and other plier-like tools have been manufactured in a forging process from both ferrous and non-ferrous metals depending on the application of the tool. While this process is capable of producing handle blanks with good structural qualities, it has many disadvantages. One disadvantage is that not all materials are suitable for the forging process which limits the ability to utilize the ideal material for a particular application of the hand tool. Another disadvantage is the expense of the equipment required to produce the necessary compressive forces and the high temperatures needed to forge the metal into the desired shape. Furthermore, the dies employed are expensive because they must be capable of withstanding repeated exposure to these high compressive forces and high temperatures.

Another disadvantage is the cost associated with producing the handle blank. In addition to the above, the forging process typically requires many cycles from the forging hammer or hammers to form the metal into the desired shape. This reduces the rate at which handle blanks can be produced thereby increasing the cost per handle blank and reduces productive availability of the expensive equipment. As a result of the equipment, the forging dies and the temperatures involved, the forging process is also not well adapted for short run sizes which increases costs associated with inventory and scrap.

Still another disadvantage is the expense associated with machining the handle blank after the forging process. The forging process is not well adapted to accurately producing intricate shapes or contours. Therefore, expensive secondary operations are required to produce the working surface of the hand tool. These operations typically require precise cutting or machining to produce these working surfaces by specialized equipment, tooling and by highly skilled operating personnel. The machining of these working surfaces by trained personnel is a very laborious and tedious task, and therefore, a costly labor intensive operation. It is often necessary to provide special cooling techniques within the equipment to control the temperature associated with metal removal to prevent adverse affects to the structure of the metal. This is especially difficult with respect to machining intricate curves or other contours.

Another method of producing hand tools utilizes flat sheet stock that is stamped to produce the handle blank. A stamping die is typically used to produce the edge geometry from the sheet stock which results in a handle that has a substantially uniform thickness based on the thickness of the sheet stock. While this process reduces much of the cost associated with forging handle blanks, it also has many disadvantages associated with producing many types of crimpers, cutters and other plier-like tools. While many materials can be stamped, many are not well suited for the stamping process. Materials that have properties that are advantageous to produce a durable hand tool, such as high carbon steels, can often cause premature die wear or die failure.

Even though the stamping process is capable of producing edge geometry, its ability to produce an accurate edge geometry, capable of use as a working surface, is limited.

One limitation is that high volume dies do not have the accuracy required to repeatedly produce the dimensional requirements of many working surfaces. Furthermore, the stamping process does not produce a clean flat edge unless expensive, fine blanking techniques are used. This condition is worsened as the thickness of the sheet stock is increased. In some cases less than 20 percent of the edge is flat while the remainder is either rounded or ragged. As a result, these surfaces must be machined if they are to be used as a working surface.

Another disadvantage is the limited ability to produce shapes or contours other than edge geometry. As stated above, the stamping process is mainly utilized to create only the edge geometry that has a uniform thickness based on the thickness of the sheet stock. While this is effective in producing the general handle shape, secondary operations are utilized when contours or shapes are required to change the thickness of the sheet stock or produce a component that is not generally flat. This can include a secondary stamping operation to bend or form the handle blank, such as to make the handles or jaws line up when a lap joint is used to assemble the two handle blanks. In addition, the handle blanks may require machining if the working surface includes a tapper or if a cutting edge is to be produced. As discussed above, these secondary operations are expensive and require highly skilled operators.

In recent years, it has been found that hand tools can be constructed of a plurality of laminations. A considerable time and cost savings has been realized by constructing hand tools in this manner rather than from forged material or by stamping. Machining steps utilized to remove excess material or to clean up rough edges associated with stamping heavy gauge material can be considerably reduced or eliminated. The laminations are produced individually to a predetermined edge contour and then stacked in the proper sequence to form the desired thickness. Once stacked in the proper sequence, they are suitably fastened together to form an integral unit. Typically, they are fastened together by rivets. The edge geometry may be cut by utilizing standard machining or stamping techniques, or they can be cut by a laser beam, plasma cutters or other suitable cutters, as is well known in the art. By stamping thinner gauge metal, a better edge quality is produced wherein there is less roundness and raggedness. Furthermore, if stamping dies are utilized, they are subjected to lower forces due to the thinner material which allows smaller less expensive dies to be utilized and promotes longer die life.

The laminating method fails to overcome many of the disadvantages associated with stampings as discussed above. While edge geometry is improved, the edge still includes rounded and ragged portions. Even though the amount of non-flat edge is reduced, a "step effect" is produced wherein the edge portion of each lamination includes a rounded portion, a flat portion and a ragged portion. This results in a repeated pattern of rounded, flat, ragged, rounded, flat, ragged, etc. corresponding to the number of laminations utilized. Many working edges still require the edge of the laminate to be machined in order to produce a predominantly flat edge.

It will be appreciated that the thickness of the laminations has considerable effect on the roundness and raggedness of the edges and the strength of the part. The thinner the laminations, the smaller the "step effect" created, and the less metal removal that is required to finish the edge surface. Thus, to manufacture a laminated tool requiring a minimum of finish machining after assembly, it maybe desirable to employ laminations as thin as practical for the contour of the handle being produced. Obviously, the use of thinner laminations results in an increase of the number of laminations utilized, resulting in an increase in stamping costs, in time expended on the initial handling and in the assembling of the parts.

The laminated method of construction is also not well suited for producing shapes or contours other than the edge geometry of a flat component. As discussed above, the stamping process is best suited for producing only edge geometry with a uniform thickness based on the sheet stock. The laminating process does little to solve this problem. Therefore, costly machining operations are still utilized to produce working surfaces that include tappers or other contours that alter the thickness of the sheet stock. This is especially true when dimensional accuracy is critical.

Another disadvantage with each method discussed above is that the jaw assembly is integral with the handle being formed and/or machined out of the same part. As a result, the handle portion and the jaw portion of the tool are made of the same material. It is well known in the art that the optimal material for any component is based on its application. In addition, the optimal surface finishing or heat treatment is determined by the application. It is common for the jaw portion of a hand tool to have a different optimal material, finish or heat treatment than the handle portion. For example, while the working surface of a jaw might require a surface hardness of over 60 $R_c$ to maintain its shape, it may be desirous for the corresponding handle portion to have a low Rockwell Hardness so that it will yield under a heavy load versus fracturing. Therefore, when handles and jaws are created from one component, a compromise must be made. Typically, the material is chosen based on the needs of the working surfaces, but this causes the handles to be made of expensive material which adds unnecessary costs to the tool. This is emphasized by the fact that the handles of a tool typically require the greatest amount of material.

Some tools have utilized a separate jaw assembly that is riveted or screwed to the handle to produce the finished part. Rivets or screws are utilized to withstand the forces produced or the general usage requirements for a plier-like assembly. However, rivets or screws add to the overall cost of the tool as well as the manufacturing time in assembling the tool. In addition, it is advantageous that a jaw portion be as compact as possible to allow access to confined work spaces. Rivets and screws can adversely increase the overall size of the jaws.

SUMMARY OF THE INVENTION

The present invention advantageously provides an improved hand tool assembly which utilizes a unique jaw design that reduces the cost of the tool while maintaining and improving the functional aspects of the laminated tool.

In this respect, a hand tool assembly is provided which comprises longitudinally extending first and second rigid metal members each having a handle portion, a throat portion and a working end. The rigid members are joined by a pivot pin in a scissors-like arrangement at the throat portion whereby the working ends are caused to move toward each other in response to the handle portions being moved toward each other. The first and second rigid members are of laminated construction, each of the handle portions including a plurality of substantially flat laminations. First and second metal jaws are provided which are adhesively affixed to the working end of the first and second rigid members, respectively. The invention further provides that each of the first and second jaws includes a key portion, while each of the first and second rigid members includes a keyway. The key portion of the jaws is aligned in the keyway of the rigid members upon assembly. This jaw design allows that the jaws may be assembled with the use of adhesive, while maintaining a compression force between the jaws and rigid members necessary to keep the jaws in place during operation.

In accordance with one aspect of the invention, the design geometry of the jaws allows for significant surface contact with the working portion of the laminated handles for increased adhesion while the jaw includes strategically placed voids to reduce unnecessary material usage. The key-keyway combination allows that the jaw can actually extend longitudinally beyond the working end of the rigid member to which it is attached, while still remaining in compression with the rigid member during operation. As is generally known, an adhesive does not function as well if subjected to tension or shear forces. Therefore, if these forces are applied between the jaw and the rigid member when a crimping or cutting action takes place, the adhesive will tend to weaken and ultimately, with use, will fail. The key-keyway combination prevents these forces from being applied to the adhesive even when the jaw is closed, thus providing for a strong and rigid connection. This is so even when the jaw extends longitudinally beyond the working end of the rigid member. As will be appreciated by one skilled in the art, a cutting or crimping action at the furthermost end of the jaw away from the pivot will set up shear and bending forces between the jaw and the rigid member unless those forces are counteracted in some way. In the prior art, the forces are counteracted with the use of rivets to attach the jaw to the rigid member. However, unlike rivets, the present invention allows the tool to have a thinner profile so that it can access areas in tight confines without the obstructions which might be provided by rivets extending into the work space.

In accordance with another aspect of the invention, the metal jaw is produced by metal injection molding. This process produces a finished piece which eliminates costly machining steps. The process also allows expensive high-strength material to be utilized only where it is required, i.e. at the cutting or crimping end and not within the handle structure. This process also allows for different jaw designs to be used on identical rigid members. The working edges of the jaws are changed, but the jaws are affixed to the rigid members in the same manner. Since different jaw designs can be applied to the same rigid member, tooling costs are reduced. This allows for flexible dedicated tooling that can produce a high volume of different pieces. Thus, one handle combination can be used to produce many tools. Different types of metals can be used for the jaws and heat treated as necessary.

In accordance with yet another aspect of the invention, a molded metal jaw is provided for affixing to a laminated hand tool assembly. The molded metal jaw includes a portion for affixing to the working ends of the hand tool assembly and an operating portion to perform the function of the hand tool assembly. The operating portion includes an anvil surface for coacting with the complementary working end of the hand tool, the anvil surface being defined by an inside edge adjacent the pivot pin and an opposite outside edge, the outside edge having a length greater than the inside edge. Furthermore, first and second edge surfaces extend longitudinally outward from the inside edge towards the outside edge surface, the first edge surface generally diverging from the second edge surface. In the preferred embodiment, the anvil surface is a trapezoid. This geometry uniquely provides an anvil surface which prevents crossover during use of the hand tool, but also provides a small width area which is preferred at the throat of the anvil near the pivot where cutting forces are greatest. This geometry is difficult and expensive to implement in forged or stamped cutting tools. The laminated assembly allows that molded metal jaws of varying dimensions can be provided on the crimping or cutting tool, which thusly prevents crossover without affecting the forces required to cut a large workpiece.

In yet another aspect of the invention, molded handle covers can be utilized on the handle portions of the tool to help secure the laminations together to further reduce the number of fasteners required. These handle covers include shaped recesses to matingly engage the laminations of the laminate and hold the laminations in place. When used in connection with the jaw design described above, the fasteners utilized to hold the laminations together can be elliminated.

It is thus an outstanding object of the present invention to provide an improved hand tool assembly which comprises molded metal jaws adhesively affixed to rigid members of the hand tool assembly.

It is yet another object of the present invention to provide an improved hand tool assembly having laminated rigid members and a molded metal jaw which is keyed to the laminations to provide a compression fit therebetween.

Still another object of the present invention is to provide a hand tool assembly in which a single handle combination can be used to produce many tools.

Yet another object of the present invention is to provide a hand tool assembly which reduces the number of mechanical components to produce the tool.

Yet still another object of the present invention is to provide a hand tool assembly which improves the overall strength of the tool, while decreasing costs of manufacture and assembly.

Still yet another object of the present invention is to provide a molded metal jaw for use with a hand tool assembly which can be produced with less material than heretofore possible.

Another object of the present invention is to provide a molded metal jaw which can be produced in structurally simple molds and is ready for application to the tool without machining.

Another object of the present invention is to provide a molded metal jaw for a hand tool assembly which can be applied to laminations without the need for fine tolerances in fitting the pieces together.

Still yet another object of the present invention is to provide a cutter that includes an anvil that prevents crossover and reduces the hand force required to cut a workpiece.

Yet still another object of the present invention is to provide handle covers that are integral to the handle portions of the hand tool and help fasten together the laminations.

These and other objects of the invention will become apparent to those skilled in the art upon reading and understanding the following detailed description of the embodiment.

BRIEF DESCRIPTION OF THE DRAWINGS

The invention may take physical form in certain parts and arrangement of parts, the preferred embodiment of which will be described in detail and is illustrated in the accompanying drawings which form a part hereof, and wherein.

DESCRIPTION OF THE PREFERRED EMBODIMENTS

Figure 1:
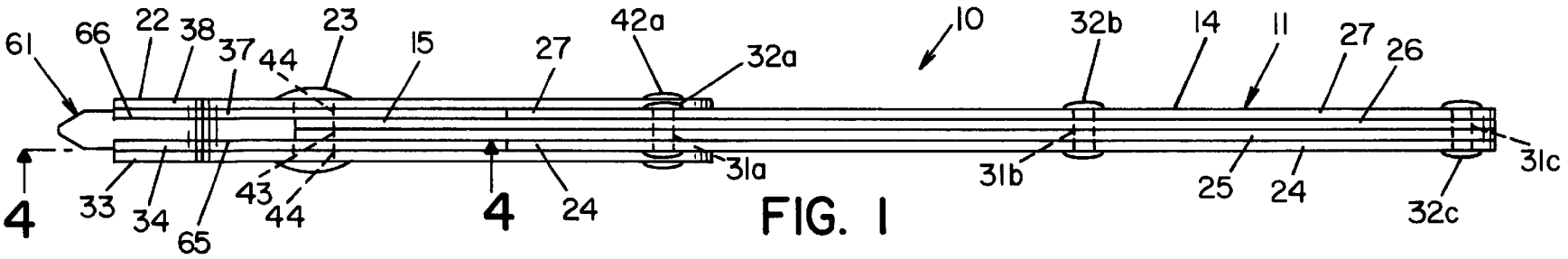
FIG. 1 is a plan view of a hand tool assembly in accordance with the present invention.
Figure 2:
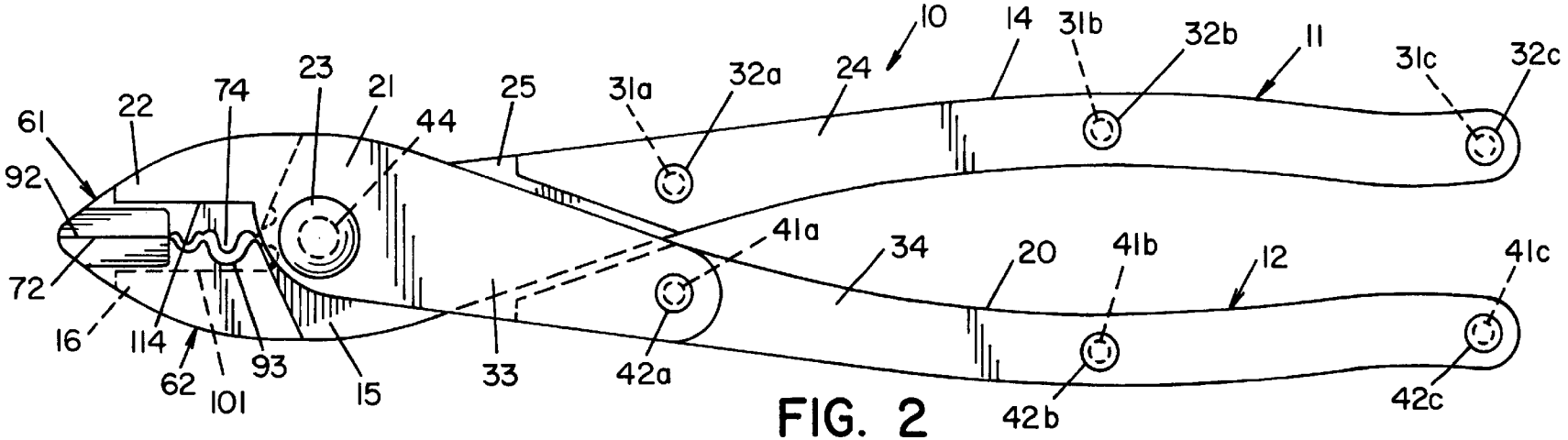
FIG. 2 is an elevation view of the hand tool assembly shown in FIG. 1.
Figure 3:
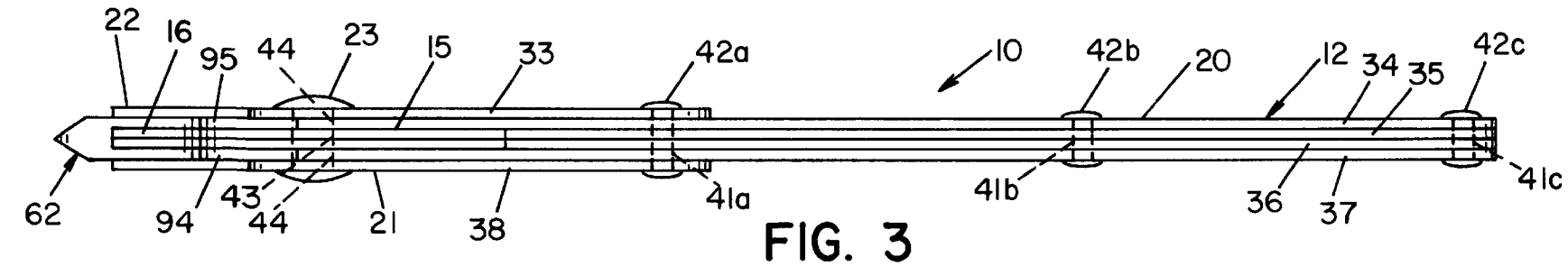
FIG. 3 is a bottom view of the hand tool assembly.

Referring now to the drawings wherein the showings are for the purpose of illustrating preferred embodiments of the invention only and not for the purpose of limiting same, FIGS. 1–3 show a hand tool assembly 10 comprising a first rigid member 11 and a second rigid member 12. First rigid member 11 includes a handle portion 14, a throat portion 15 and a working end 16, and second rigid member 12 includes a complementary handle portion 20, a throat portion 21 and a working end 22. Member 11 is joined to member 12 at throat portions 15 and 21 by a pivot pin 23. As can be seen, working ends 16 and 22 are caused to move toward each other in response to handle portions 14 and 20 being moved toward each other.

Figure 9:
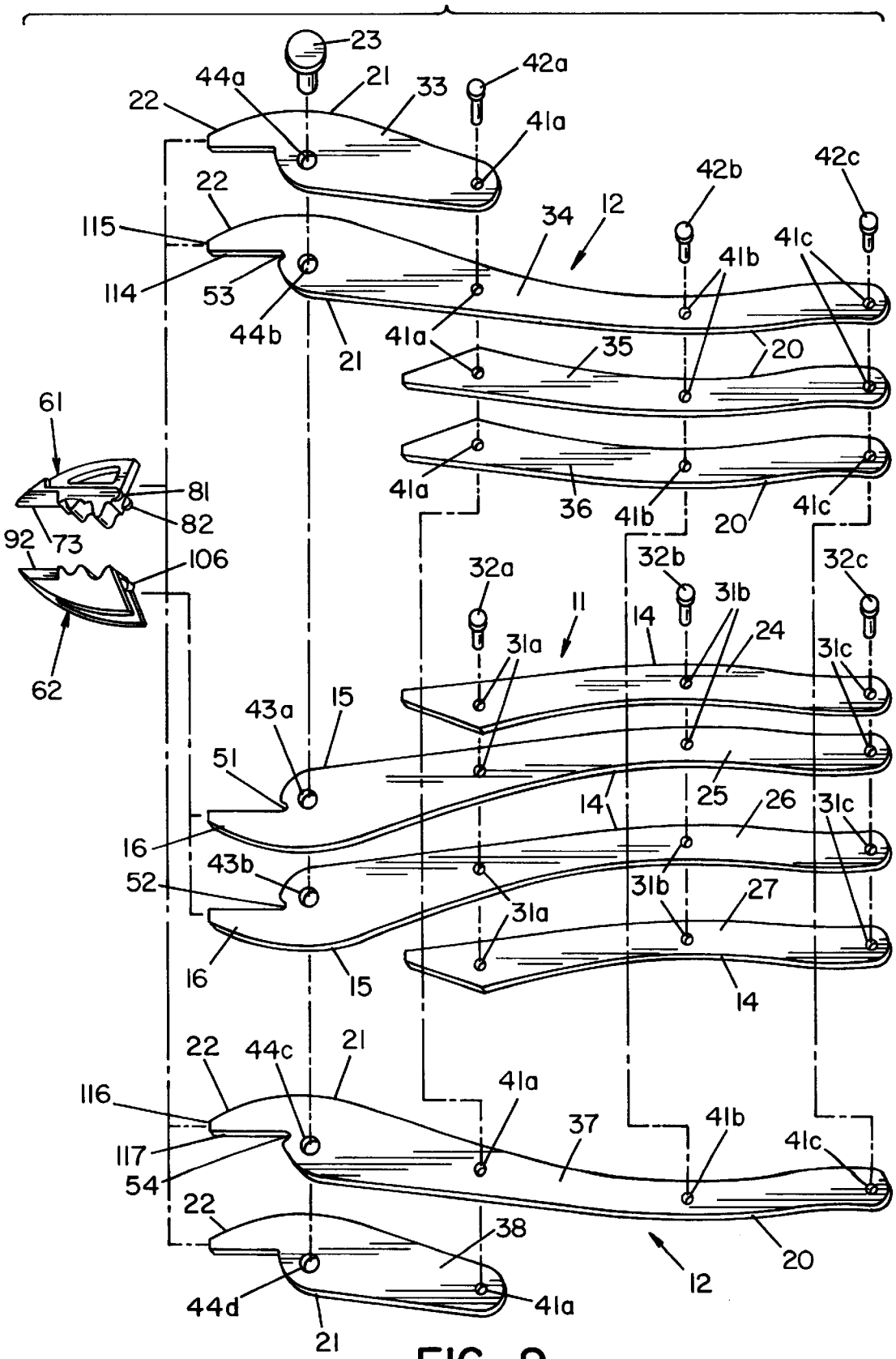
FIG. 9 is an exploded view of the hand tool assembly shown in FIGS. 1–3.

In the embodiment shown, rigid member 11 is comprised of a plurality of substantially flat laminations 24, 25, 26 and 27, and as can be seen from FIG. 9, laminations 24 and 27 are identical, and laminations 25 and 26 are identical. The laminations each have punched holes 31*a*, 31*b*, and 31*c* and the separate laminations are stacked together for each set of punched holes 31*a*, 31*b*, and 31*c* to be aligned in substantial registry with the corresponding holes of the adjacent lamination. Rivets 32*a*, 32*b*, and 32*c* then bind laminations 24 through 27 to provide first rigid member 11.

Second rigid member 12 is formed from six separate laminations, 33, 34, 35, 36, 37 and 38, and laminations 33 and 38 are identical, laminations 34 and 37 are identical and laminations 35 and 36 are identical. Each of laminations 34, 35,36, and 37 includes punched holes 41*a*, 41*b*, 41*c*, and laminations 33 and 38 only include punched holes 41*a*. Like rigid member 11, rigid member 12 is assembled by stacking laminations 33 through 38, aligning each set of holes 41*a*, 41*b* and 41*c* of the adjacent laminations, and then binding the laminations by setting rivets 42*a*, 42*b*, 42*c* within punched holes 41*a*, 41*b*, 41*c*, respectively. As can be seen from FIGS. 1–3, member 11 includes a hole 43 for pivot pin 23 and rigid member 12 includes a hole 44 for the pivot pin. As can be seen in FIG. 9, pivot hole 43 is comprised of holes 43*a* and 43*b* in laminations 25 and 26, respectively, and hole 44 is comprised of holes 44*a*, 44*b*, 44*c* and 44*d* in laminations 33, 34, 37, and 38, respectively. Holes 43 and 44 are aligned and pivot pin 23 is placed therethrough, thus forming throat portion 21 of hand tool assembly 10.

Figure 4:
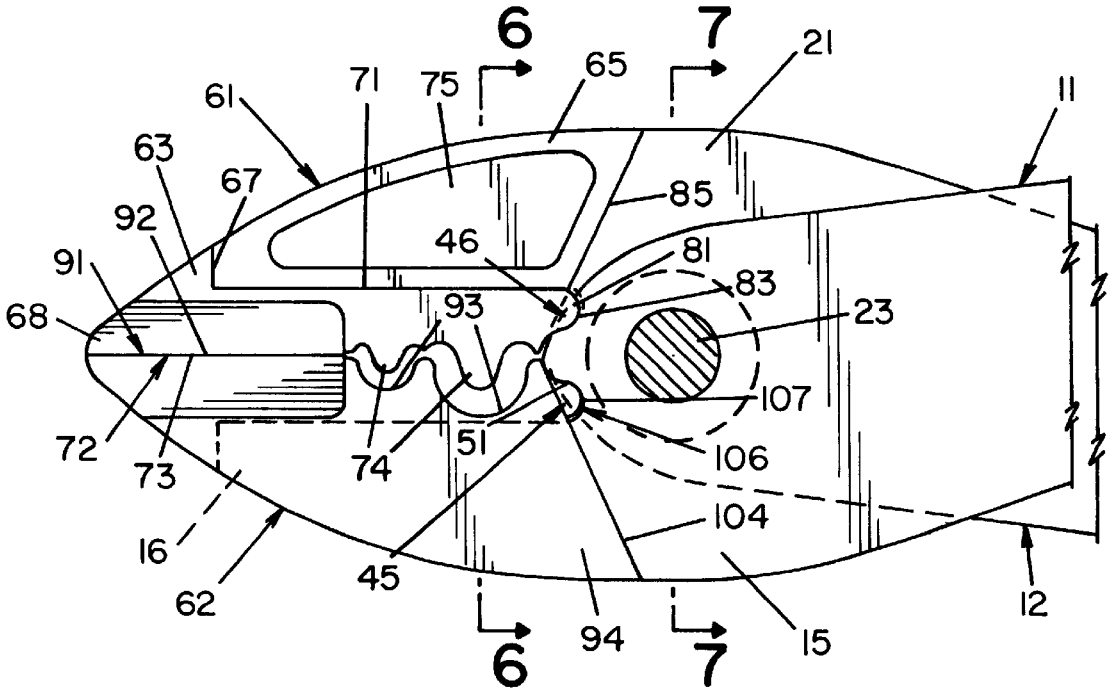
FIG. 4 is a detailed view, partially in cross-section, taken along line 4—4 in FIG. 1.
Figure 5:
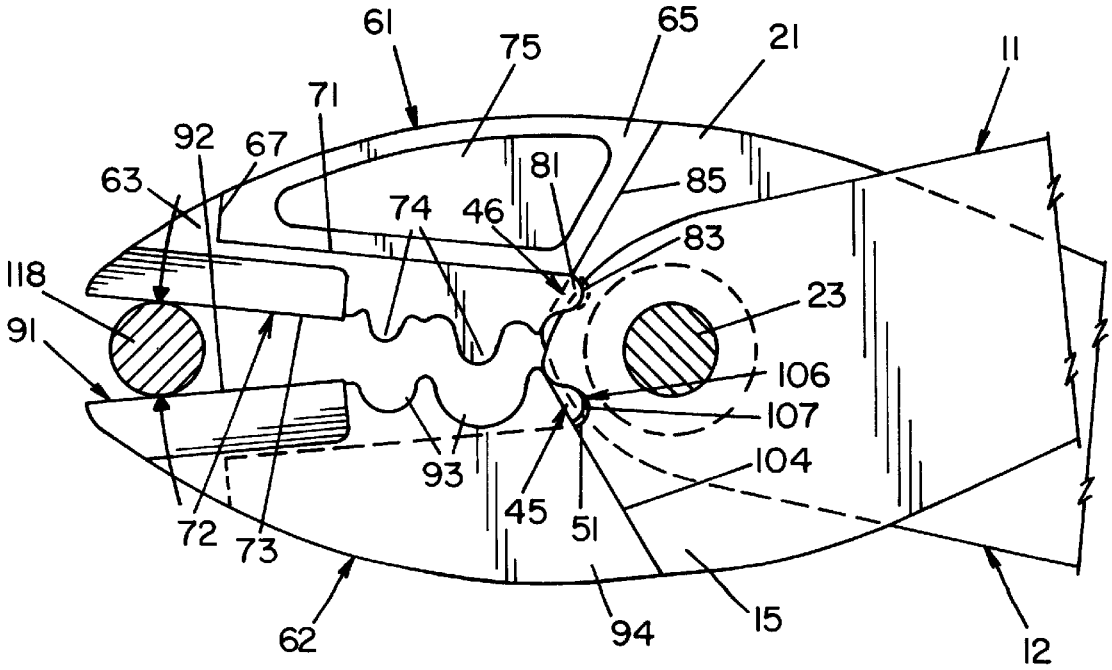
FIG. 5 is a detailed view, partially in cross-section, showing the jaws of FIG. 4 in an open position.
Figure 6:
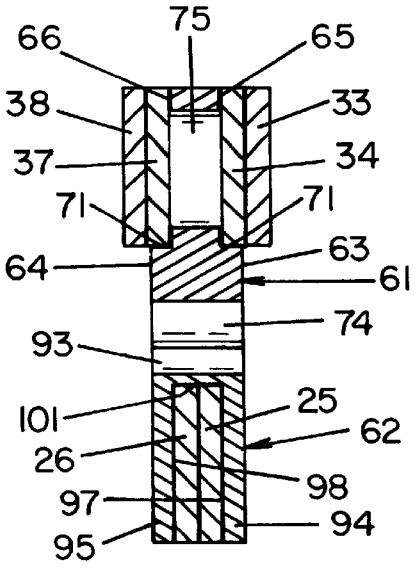
FIG. 6 is a cross-sectional elevation view taken along line 6—6 in FIG. 4.
Figure 7:
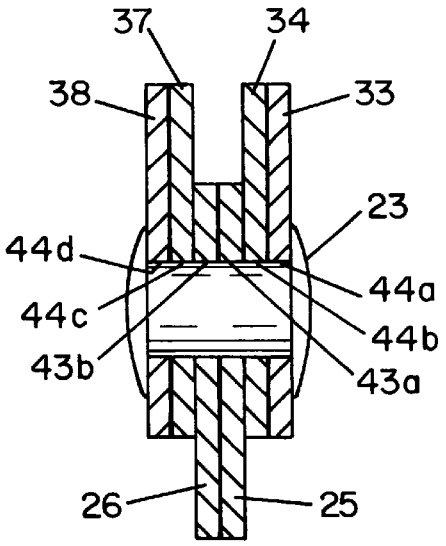
FIG. 7 is a cross-sectional elevation view taken along line 7—7 in FIG. 4.
Figure 8:
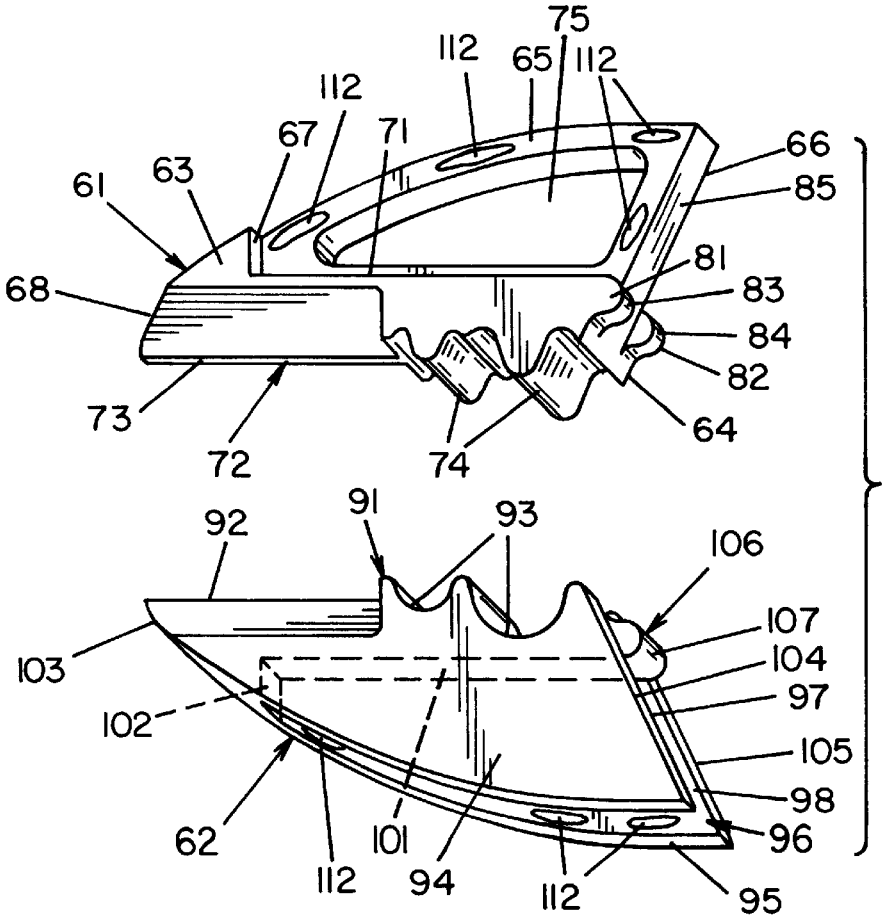
FIG. 8 is an exploded view of one embodiment of the jaws of the hand tool assembly.

As can be seen from FIGS. 1–3 and FIG. 9, laminations 35 and 36 of rigid member 12 and laminations 24 and 27 of rigid member 11 only extend the length of handle portions 14 and 20, respectively. This allows clearance between rigid members 11 and 12 in order that the two handle portions may pivot with respect to each other during operation. It will be appreciated that there are a number of different handle designs which may be utilized depending upon the application and strength requirements of the user. Obviously, certain applications or strength requirements may require additional laminations, different clearances, and/or different or longer handle designs. As seen in FIG. 4, rigid member 11 includes a notched keyway 45 and rigid member 12 includes a notched keyway 46. As seen in FIG. 9, keyway 45 is formed from notches 51 and 52 in laminations 25 and 26, respectively, while keyway 46 is formed by notches 53 and 54 in laminations 34 and 37, respectively. The function of keyways 45 and 46 is described below.

Hand tool assembly 10 further includes an upper jaw 61 and a lower jaw 62 attached to working end 22 of rigid member 12 and working end 16 of rigid member 11, respectively. The tool shown in FIGS. 1–5 is an electrician's crimper, and it will be appreciated that many other jaw designs can be used, such as the alternative designs shown in and described hereinafter in connection with FIGS. 11 and 12. The jaws 61 and 62 are preferably produced from metal by injection molding. This process produces a finished piece, thereby eliminating costly machining steps. It also allows expensive high-strength material to be utilized only where it is required, i.e in the jaws. For example, in the preferred embodiment, the electrician's crimper shown uses 52100 series steel as the jaw material. This chromium steel alloy has traditionally been used for bearing races. In contrast, rigid members 11 and 12 can be formed from pre-heat treated steels that produce better edges when stamped, thereby reducing finishing requirements. The strength of the handle design comes not only from the steel itself but from the plurality of laminations stacked together. It will be appreciated that metal injection molding requires less tooling costs since different inserts can be placed in the mold for different jaw designs. Thus, in contrast to the prior art, costs to produce variations of hand tool assembly 10 and variations thereof are minimal.

Upper jaw 61 and lower jaw 62 are best seen in FIGS. 4–8 and will be described with reference thereto. Upper jaw 61 includes the opposite outer surfaces 63 and 64 with outer surface 63 having a first recessed portion 65, and outer surface 64 having a second recessed portion 66. Recessed portions 65 and 66 extend inwardly toward throat portion 21 of member 12, and are defined by a nose end wall 67 adjacent an upper nose tip 68 of upper jaw 61 and a wall 71 parallel to a jaw edge 72 of jaw 61. As shown, edge 72 includes a linear anvil surface 73 for use against a complementary knife surface on jaw 62 which will be described below, and male crimping projections 74 which are arcuate and extend outwardly from anvil surface 73. Crimping projections 74 act in conjunction with female crimping recesses on lower jaw 62 which will be described below. As can be seen from FIG. 8, an opening 75 extends between recessed portions 65 and 66 and advantageously reduces the amount of chromium steel alloy or other expensive high strength metal material needed for jaw 61, without reducing the overall rigidity or strength of jaw 61. Recessed portions 65 and 66 extending about opening 75 allow for the application of adequate adhesive material to bond jaw 61 to rigid member 12, as will be described below. Outer surfaces 63 and 64 include longitudinally extending keys 81 and 82, respectively, and keys 81 and 82 include longitudinally inwardly extending arcuate surfaces 83 and 84, respectively, adapted to be inserted into notch keyway in member 12. Extending between recessed portion 65 and recessed portion 66 is an inward facing edge 85 which extends upwardly at an angle from surface 72 and between keys 81 and 82.

Lower jaw 62 includes a lower jaw teeth surface 91 which includes a complementary knife surface 92 to coact against anvil surface 73, and female crimping recess 93 for coacting with male crimping projection 74. Lower jaw 62 further includes opposite flange portions 94 and 95 which define a working end opening 96 extending between inside surfaces 97 and 98 of flange portions 94 and 95, respectively. Opening 96 further includes bearing wall 101 and a nose bearing wall 102 generally perpendicular to bearing edge wall 101 between inside surfaces 97 and 98. Bearing wall 102 is adjacent to nose tip 103 of jaw 62. Flange portions 94 and 95 include inwardly facing edges 104 and 105, respectively, and a lower jaw key 106 extends longitudinally inwardly from edges 104 and 105 adjacent bearing wall 101 and between edges 104 and 105 which extend downwardly therefrom. Lower jaw key 106 is defined by a longitudinally inwardly extending arcuate surface 107, and is adapted to fit into notched keyway 45 in rigid member, as described herein.

In connection with assembling hand tool 10, an adhesive 112 is placed upon first recessed portion 65 and second recessed portion 66 of upper jaw 61, and upper jaw 61 is then placed between the inner surfaces of the working edges of laminations 34 and 37 of rigid member 12 with keys 81 and 82 engaged within notches 53 and 54 defining keyway 46. As will be appreciated from the foregoing description and FIG. 9, bearing edges 114 and 115 of lamination 34 engage walls 71 and 67 of recess 65, respectively, to position the jaw on the working ends. Adhesive is also preferably placed between these abutting edges and walls. At the same time, the bearing edges 116 and 117 of lamination 37 are placed in abutting contact with walls 67 and 71 of recess 66, respectively. An adhesive designed to bond together metal components is used to secure the jaws 61 and 62 and it has been found that MASTERBOND SUPREME 10HT works well in this application. MASTERBOND is heat cured at 250 degrees F. for sixty minutes. Once cured, it can withstand temperatures ranging from minus 200 degrees F. to 500 degrees F. As will be appreciated from the description, the bearing surfaces formed by walls 67 and 71 form bearing surfaces for abutting against edges 114, 115, 116 and 117 of rigid member 12. As can be seen from FIG. 5, this bearing surface contact together with the keys 81 and 82 within notched keyway 46 ensures that at least a portion of upper jaw 61 is always supported against compression with rigid member 12. In a complementary manner, lower jaw 62 is adhesively affixed to laminations 25 and 26 of rigid member 11. In this respect, adhesive 112 is placed on the inside surfaces 97 and 98 of flange portions 94 and 95 and on walls 101 and 102 of recess 96 after which jaw 62 is mounted over the working ends of laminations 25 and 26 to position lower jaw key 106 within notches 51 and 52 providing notched keyway 45. Adhesive 112 holds jaws 61 and 62 in place and, as with jaw 61, a portion of jaw 62 is always supported against compression with rigid members 11. Compression between jaws 61 and 62 and rigid members 11 and 12 is ensured even though upper nose tip 68 and lower nose tip 103, which define an operating end of jaws 61 and 62, extend longitudinally beyond working end 16 of members 11 and 12. In this respect, as will be appreciated from FIG. 5, forces acting between keys 81 and 82 and keyways 45 and 46 provide a compression fitting while a wire 118 is cut at upper nose tip 68 and lower nose tip 103 of the hand tool. The jaw design allows for the use of adhesive to affix the jaws to the handle since the jaws will always be supported against compression by at least a portion of the handles. In addition, the design allows for significant surface contact with the working ends of the rigid members for increased adhesion while still including strategically placed voids to reduce material usage.

Figure 10:
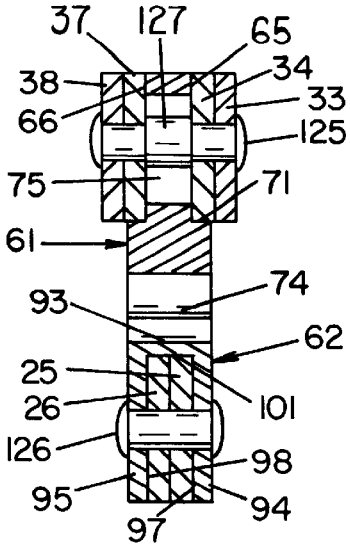
FIG. 10 is a cross-sectional elevation view similar to FIG. 6 and showing an alternative embodiment of the jaw mounting.
Figure 11:
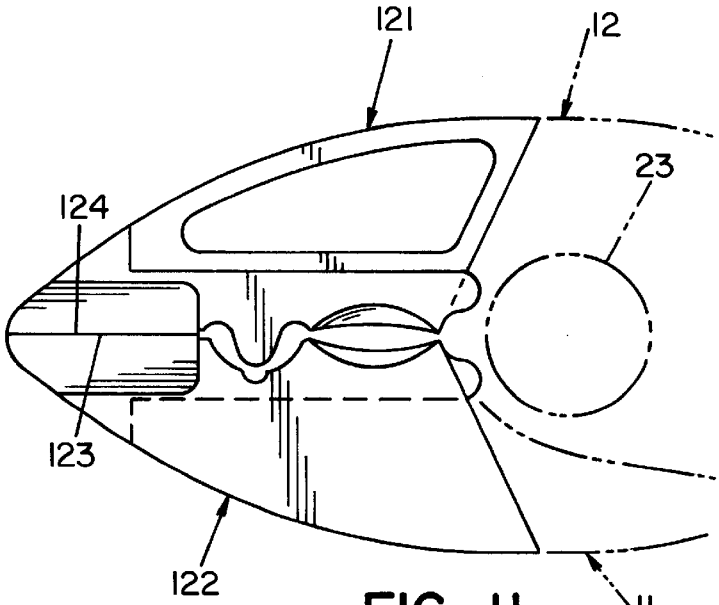
FIG. 11 is a view similar to FIG. 4 showing another embodiment of the jaws.
Figure 12:
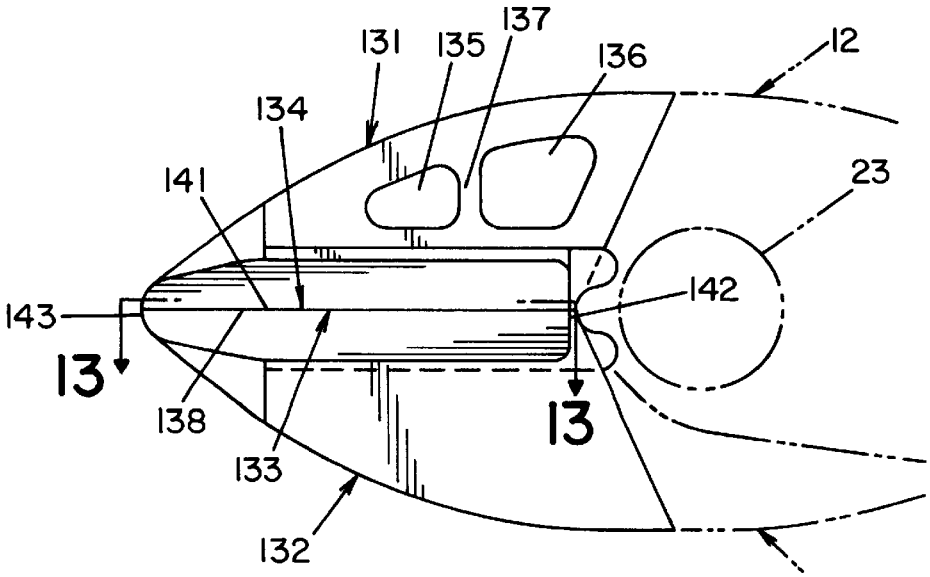
FIG. 12 is a view similar to FIG. 11 showing yet another embodiment of the jaws.
Figure 14:
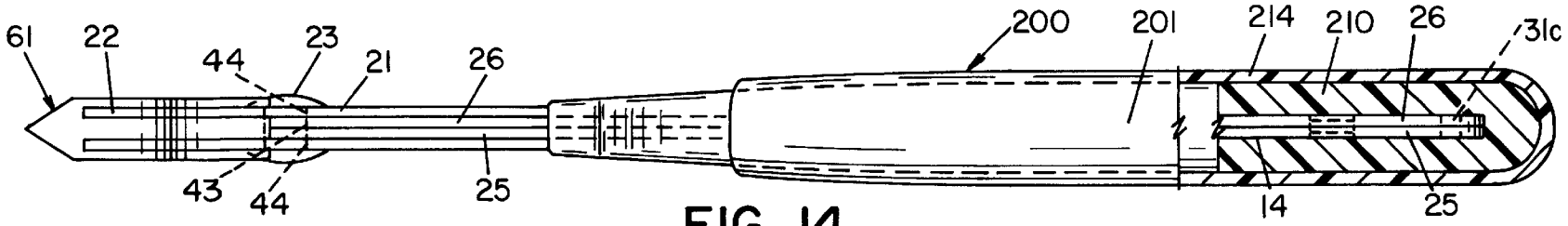
FIG. 14 is a plan view of another embodiment of a hand tool in accordance with the present invention.
Figure 15:
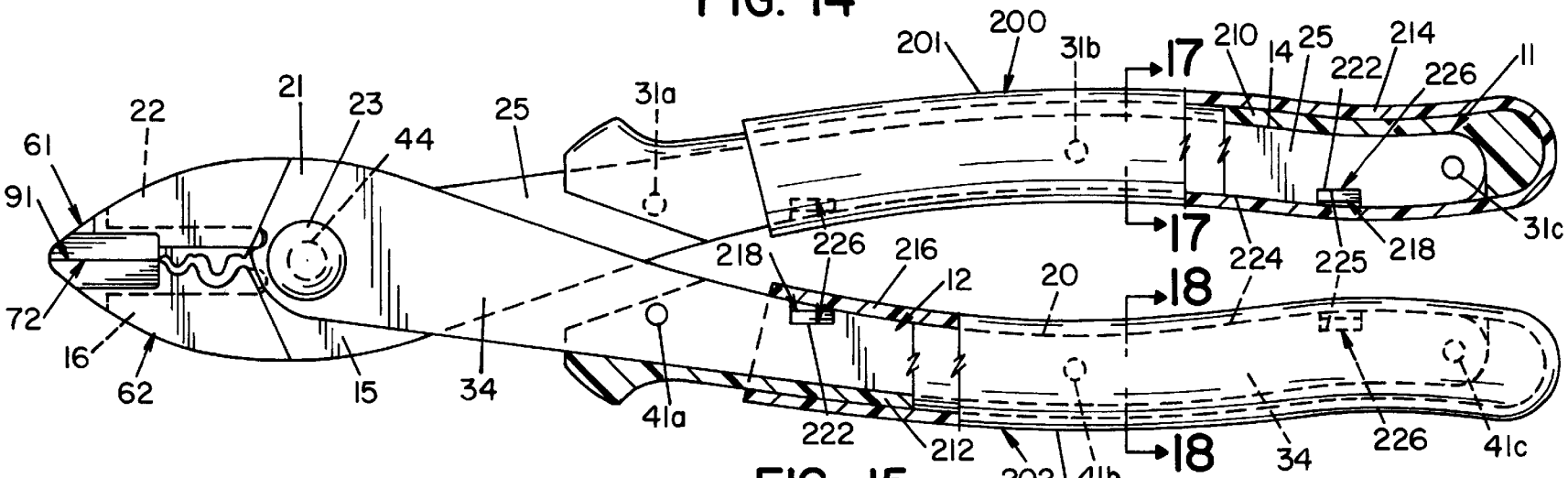
FIG. 15 is an elevation view of the hand tool shown in FIG. 14.
Figure 16:
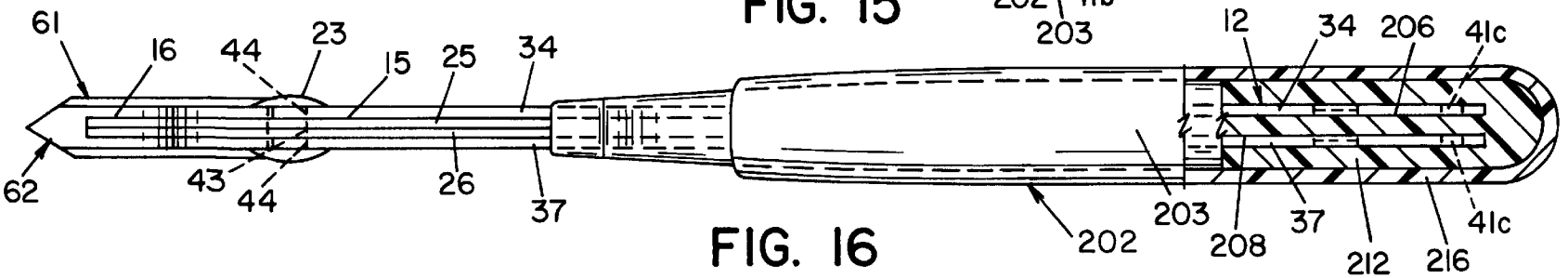
FIG. 16 is a bottom view of the hand tool assembly shown in FIG. 14.

Alternative embodiments of jaws 61 and 62 are also contemplated. As shown in FIG. 10, it will be appreciated that instead of or in addition to adhesive, a single rivet such as rivets 125 and 126, with a sleeve 127 spanning void space 75 in jaw 61, may be placed toward tips 68 and 103 for mounting the jaws 61 and 62 in the corresponding working end. The rivets in conjunction with the keys and keyways described will act to keep jaws 61 and 62 supported against compression. FIG. 11 shows jaws 121 and 122 fitted to rigid members 11 and 12, respectively, in a manner similar to that shown in FIGS. 1–9. Jaws 121 and 122 are constructed with surfaces 123 and 124 to show that any multitude of crimper and cutter designs can be used on the hand tool assembly 10. Like FIG. 11, FIG. 12 shows another embodiment of jaws wherein jaws 131 and 132 utilize linear working surfaces 133 and 134, respectively. As can be seen, jaw 131 includes separate void spaces 135 and 136 with a cross member 137 therebetween for additional strength.

Figure 13:
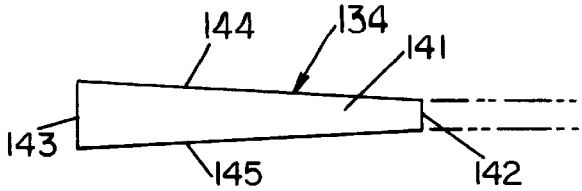
FIG. 13 is a plan view looking in the direction of line 13—13 in FIG. 12.

FIG. 13 shows a cross-section taken along line 13—13 of FIG. 12. As can be seen, working surface 134 is actually an anvil surface 141 complementary to a knife surface 138 formed by linear surface 133. Anvil surface 141 in this configuration eliminates cross-over between the anvil surface and knife surface without increasing the cutting force close to the pivot. As will be appreciated, the larger the wire, the greater the cutting force required. The greatest force can be applied closest to the pivot pin 23. A flat wide anvil surface requires more cutting force to cut the same wire than a narrow anvil surface. However, a narrow anvil surface, which in effect forms a second cutting blade or similar thereto, allows cross-over of the upper and lower jaws. Anvil surface 141 has a longitudinally inner edge 142 adjacent pivot pin 23 and an opposite outside edge 143. Outside edge 143 has a length greater than inside edge 142. Extending between inside edge 142 and opposite edge 143 is a first edge surface 144 and a second edge surface 145. First and second edge surfaces 144 and 145 diverge in relation to each other from edge 142 toward edge 143, while inside edge 142 is generally parallel to outside edge 143 to form a trapezoid anvil surface 141. It will be appreciated that in the preferred embodiment, the length of inside edge surface 142 is about 0.015 inches wide. In addition, trapezoid anvil surface 141 can be limited to the outer portion of the anvil surface. More particularly, a portion of the anvil has traditional parallel edges while the remainder of the anvil includes the trapezoid configuration 141.

Applicant's invention allows the narrowest possible anvil surface to reduce the cutting force necessary to cut the same amount of wire while preventing cross-over by widening the anvil surface longitudinally outward from the pivot pin 23. This area is generally not used for cutting except for thin wires. By providing a wide surface adjacent outside edge 143, thinner wire is more easily cut since the wide anvil surface 141 adjacent outside edge 143 tends to stabilize a fine strand of wire and hold it steady for cutting. A finer, cleaner cut of thin wire strands is thus achieved.

Referring to FIGS. 14–22, another embodiment of the present invention is shown. Laminations 24 and 27 are eliminated from the handle portion of rigid member 11. In their place, handle cover 200 is mounted to the remaining laminations 25 and 26. Even though the use of laminations produces a smoother edge surface, handle covers are important to create a cushion between the user's hand and the handle of the tool. In this embodiment, the cushion producing handle cover is incorporated into the laminated handle structure thereby further reducing the number of components therein. In a like manner, laminations 35 and 36 are eliminated from handle portion 20 of rigid member 12. In their place, handle cover 202 is mounted to the remaining laminations 34 and 37. In total, four laminations are eliminated from the assembly.

Figure 17:
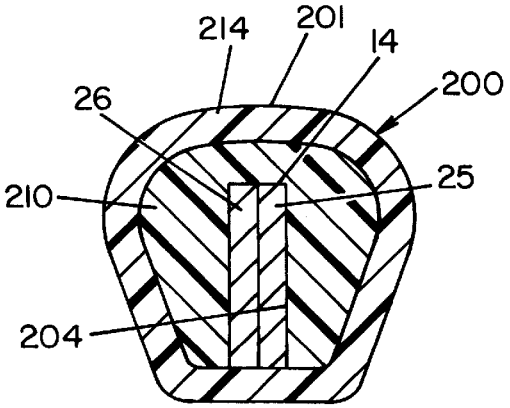
FIG. 17 is a cross-section elevation view taken along line 17—17 in FIG. 15.
Figure 18:
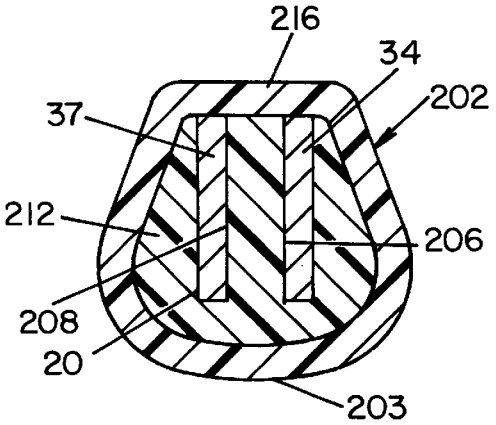
FIG. 18 is a cross-section elevation view taken along line 18—18 in FIG. 15.

Referring to FIGS. 17 and 18, a section of handle covers 200 and 202 installed on handle portions 14 and 20 respectively are shown. More particularly, cover 200 is affixed to laminations 25 and 26 thereby producing a wide hand engaging surface 201. Laminations 25 and 26 are adjacent one another and engage elongated recess 204 of cover 200. Cover 202 is affixed to laminates 34 and 37 which are parallel but space apart thereby producing wide handle engaging surface 203. Accordingly, cover 202 includes two elongated recesses 206 and 208 that individually engage laminations 34 and 37 respectively. Covers 200 and 202 can be molded out of many materials known in the art for handle covers and can include a multi-layer construction. The multi-layer construction can include cores 210 and 212 composed of material having good structural attributes and outer layers 214 and 216 enclosing the cores and having cushioning properties for comfortably engaging the user's hand.

Referring to FIGS. 19–22, recesses 204, 206 and 208 include interengagement tabs 218 having a ramping surface 220 and a locking surface 222. Tabs 218 allow covers 200 and 202 to be easily assembled on handle portions 14 and 20 respectively without the need for fasteners or adhesives. As covers 200 and 202 are forced over outer edges 223 of their respective handles, the handle portions engage ramping surface 220 thereby forcing outwardly tabs 218 to allow passage of the handle portions therebetween. Once the handle portions pass tabs 218, the tabs move inwardly back to their original position thereby engaging locking surfaces 222 against the inner edge 224 of handle portions 14 and 20 and prevent removal thereof.

Figure 23:
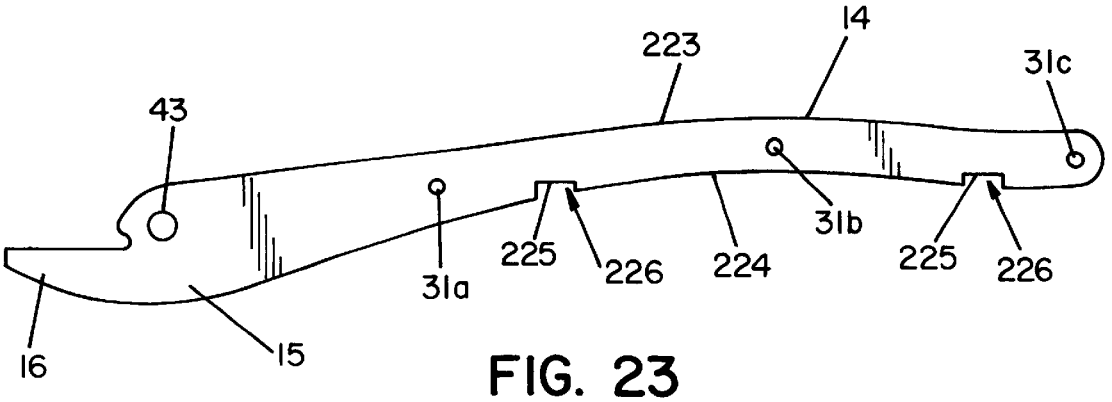
Figure 19:
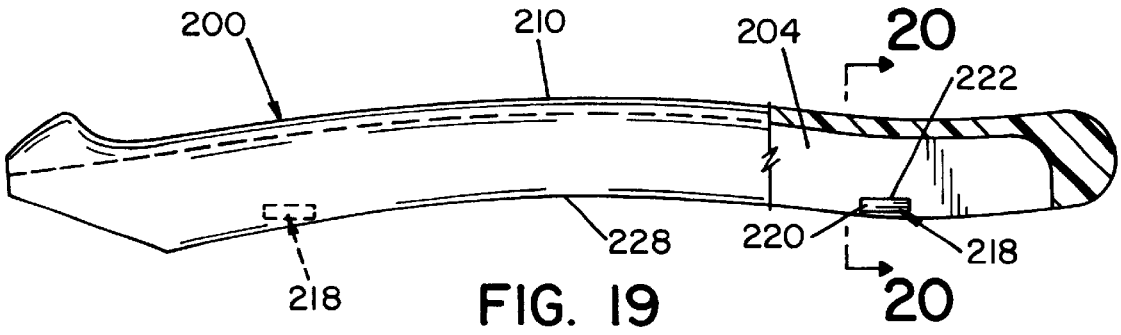
FIG. 19 is an elevation view of one of the handle covers of the hand tool shown in FIG. 14.
Figure 20:
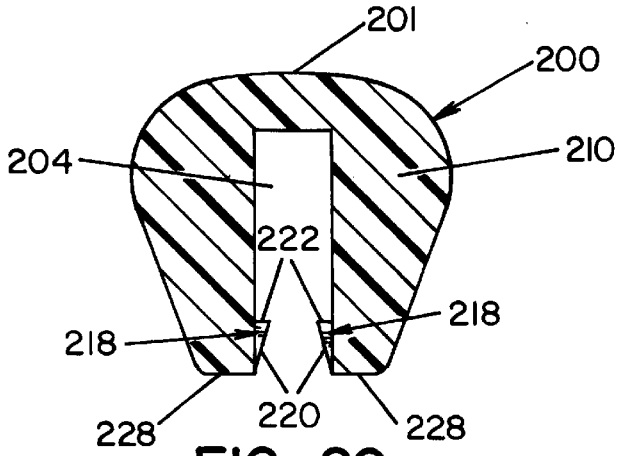
FIG. 20 is a cross-sectional elevation view taken along line 20—20 in FIG. 19.
Figure 21:
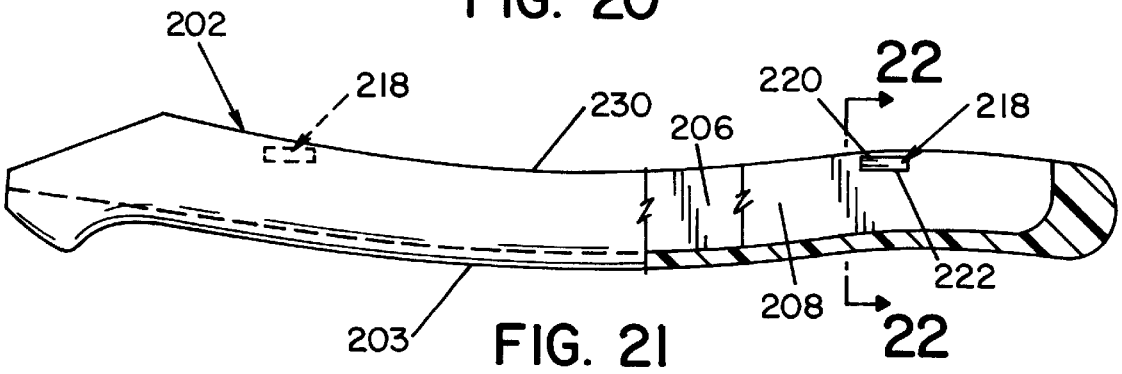
FIG. 21 is an elevation view of another of the handle covers of the hand tool shown in FIG. 14.
Figure 22:
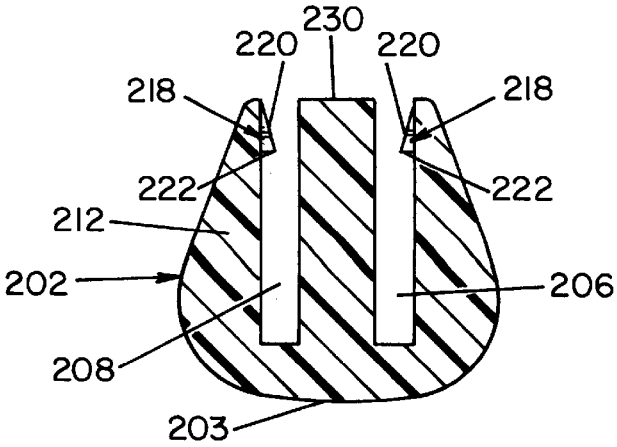
FIG. 22 is a cross-sectional elevation view taken along line 22—22 in FIG. 21; and, FIG. 23 is an elevation view of a lamination for the tool in the embodiment shown in FIG. 14.

Referring to FIG. 23 wherein only handle portion 14 is shown, handle portions 14 and 20 can include notches 226. This allows the inner surfaces 228 and 230 of cores 210 and 212 to be generally flush with inner edge 224 of the handle portions after installation. This is accomplished by having tabs 218 engage an edge 225 of notch 226 which is inward from inner edge 224. Once handle covers 200 and 202 are assembled on handle portions 14 and 20, outer layers 214 and 216 can then be installed surrounding cores 210 and 212 and handle portions 14 and 20, respectively to provide cushioned contact with the users hand.

While covers 200 and 202 can be utilized to only provide a cushion for the user's hand, they can also be used to help secure the laminations with out the use of rivets 42*a,* 42*b* and 42*c*. Covers 200 and 202 along with jaws 61 and 62, pivot pin 23 and adhesive can be utilized to maintain the assembled position of the laminates.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A hand tool assembly comprising:

longitudinally extending first and second rigid members, each having a handle portion, a throat portion and a working end, the members being joined by a pivot pin in said throat portion for the working ends to move toward each other in response to the handle portions being moved in one of directions toward and away from each other;

the first rigid member being of laminated construction and the handle portion thereof including a plurality of substantially flat laminations;

the second rigid member being of laminated construction and the handle portion thereof including a plurality of substantially flat laminations; and, a first jaw adhesively affixed to said working end of said first rigid member and a second jaw adhesively affixed to said working end of said second rigid member, wherein said first jaw includes an inside edge adjacent said pivot pin, an outside edge longitudinally spaced from said inside edge and a key portion extending longitudinally from said inside edge, said first rigid member includes a keyway, said key portion being received in said keyway.

2. The hand tool of claim 1, wherein said keyway is adjacent said throat portion.

3. The hand tool of claim 2, wherein said keyway extends into an edge of said first rigid member in said throat portion.

4. A hand tool assembly comprising:

longitudinally extending first and second rigid members, each having a handle portion, a throat portion and a working end, the members being joined by a pivot pin in said throat portion for the working ends to move toward each other in response to the handle portions being moved in one of directions toward and away from each other;

the first rigid member being of laminated construction and the handle portion thereof including a plurality of substantially flat laminations;

the second rigid member being of laminated construction and the handle portion thereof including a plurality of substantially flat laminations; and, a first jaw adhesively affixed to said working end of said first rigid member and a second jaw adhesively affixed to said working end of said second rigid member, wherein each of said first and second jaws includes an inside edge adjacent said pivot pin, an outside edge longitudinally spaced from said inside edge and a key portion extending longitudinally from said inside edge each of said first and second rigid members includes a keyway, each said key portion being received in a corresponding one of said keyways.

5. The hand tool of claim 4, wherein one said keyway is adjacent the other said keyway.

6. The hand tool of claim 5, wherein each said keyway is adjacent said pivot pin.

7. The hand tool of claim 4, wherein each said keyway is adjacent said pivot pin.

8. The hand tool of claim 4, wherein each of said jaws extends longitudinally beyond said working end.

9. A hand tool assembly comprising:

longitudinally extending first and second rigid members, each having a handle portion, a throat portion and a working end, the members being joined by a pivot pin in said throat portion for the working ends to move toward each other in response to the handle portions being moved in one of directions toward and away from each other;

the first rigid member being of laminated construction and the handle portion thereof including a plurality of substantially flat laminations;

the second rigid member being of laminated construction and the handle portion thereof including a plurality of substantially flat laminations; and, a first jaw adhesively affixed to said working end of said first rigid member and a second jaw adhesively affixed to said working end of said second rigid member, wherein said first jaw extends longitudinally beyond said working end of said first rigid member, and said second jaw extends longitudinally beyond said working end of said second rigid member.

10. A hand tool assembly comprising:

longitudinally extending first and second rigid members, each having a handle portion, a throat portion and a working end, the members being joined by a pivot pin for the working ends to move toward each other in response to the handle portions being moved in one of directions toward and away from each other;

the first rigid member being of laminated construction and the handle portion thereof including a plurality of substantially flat laminations;

the second rigid member being of laminated construction and the handle portion thereof including a plurality of substantially flat laminations; and, a first jaw adhesively affixed to said working end of said first rigid member and a second jaw adhesively affixed to said working end of said second rigid member, wherein said second jaw includes an opening for receiving at least one of said plurality of substantially flat laminations of said second rigid member.

11. A hand tool assembly comprising:

longitudinally extending first and second rigid members, each having a handle portion, a throat portion and a working end, the members being joined by a pivot pin whereby the working ends are caused to move toward each other in response to the handle portions being moved toward each other;

the first rigid member being of laminated construction and the handle portion thereof including a plurality of substantially flat laminations;

the second rigid member being of laminated construction and the handle portion thereof including a plurality of substantially flat laminations; and, a first jaw affixed to said working end of said first rigid member and a second jaw affixed to said working end of said second rigid member, each of said first and second jaws including an inside edge adjacent said pivot pin, an outside edge longitudinally spaced from said inside edge and a key portion extending longitudinally from said inside edge, and each of said first and second rigid members including a keyway receiving a corresponding one of said key portions.

12. The hand tool of claim 11, wherein one said keyway is adjacent the other said keyway.

13. The hand tool of claim 12, wherein each said keyway is adjacent said pivot pin.

14. The hand tool of claim 11, wherein each said keyway is adjacent said pivot pin.

15. The hand tool of claim 11, wherein each of said jaws extends longitudinally beyond said working end.

16. A hand tool assembly comprising:

first and second rigid members, each having a handle portion, a throat portion and a working end, the members being joined by a pivot pin in a scissors-like arrangement whereby the working ends are caused to move toward each other in response to the handle portions being moved toward each other;

the first rigid member of laminated construction including a plurality of substantially flat laminations;

the second rigid member of laminated construction including a plurality of substantially flat laminations; and, a first jaw adhesively fixed to said working end of said first rigid member and a second jaw adhesively fixed to said working end of said second rigid member, wherein said first and second jaws are adhesively fixed by an epoxy cement.

17. A hand tool assembly comprising:

longitudinally extending first and second rigid members, each having a handle portion, a throat portion and a working end, the members being joined by a pivot pin for the working ends to move toward each other in response to the handle portions being moved in one of directions toward and away from each other;

the first rigid member being of laminated construction and the handle portion thereof including a plurality of substantially flat laminations;

the second rigid member being of laminated construction and the handle portion thereof including a plurality of substantially flat laminations; and, a first jaw adhesively affixed to said working end of said first rigid member and a second jaw adhesively affixed to said working end of said second rigid member, wherein said first jaw includes an opening for receiving at least one of said plurality of substantially flat laminations of said first rigid member.

18. The hand tool of claim 17, wherein said second jaw includes an opening for receiving at least one of said plurality of substantially flat laminations of said second rigid member.

* * * * *